United States Patent [19]

Widmayer

[11] 4,234,820

[45] Nov. 18, 1980

[54] LIGHT REGULATION SYSTEM

[75] Inventor: Don F. Widmayer, Bethesda, Md.

[73] Assignee: Controlled Environments Systems, Rockville, Md.

[21] Appl. No.: 27,740

[22] Filed: Apr. 6, 1979

Related U.S. Application Data

[63] Continuation-in-part of Ser. No. 945,842, Sep. 26, 1978.

[51] Int. Cl.[3] ..... H05B 41/38

[52] U.S. Cl. ..... 315/152; 315/151; 315/155; 315/158; 315/294; 315/323; 315/324

[58] Field of Search ..... 315/151–156, 315/158, 159, 291, 294, 297, 323, 324, DIG. 4; 250/578

[56] References Cited

U.S. PATENT DOCUMENTS

| | | | |
|---|---|---|---|
| 3,160,757 | 12/1964 | McAllise | 315/152 X |
| 3,863,104 | 1/1975 | Bolhuis | 315/154 |
| 4,025,440 | 5/1977 | Suga | 315/151 X |

FOREIGN PATENT DOCUMENTS

| | | | |
|---|---|---|---|
| 2425721 | 12/1975 | Fed. Rep. of Germany | 315/153 |

*Primary Examiner*—Eugene R. LaRoche

*Attorney, Agent, or Firm*—Larson, Taylor and Hinds

[57] ABSTRACT

A light regulation system is provided wherein the light output of a second, fluorescent lamp fixture is regulated in accordance with the light output of a first or preceeding fluorescent lamp fixture. Each fixture includes a lamp or lamps, a ballast or ballasts and a control or regulating device which controls the ballasting of the lamp(s) of the fixture and hence the light output thereof. The system provides for monitoring the light output of the master fixture and optically coupling a corresponding signal to a photocell in the control device of the following fixture so as to control the output of the lamp(s) of the following fixture. Additional fixtures can be optically coupled in like manner to either the master or a follower fixture to provide additional controlled following fixtures.

7 Claims, 1 Drawing Figure

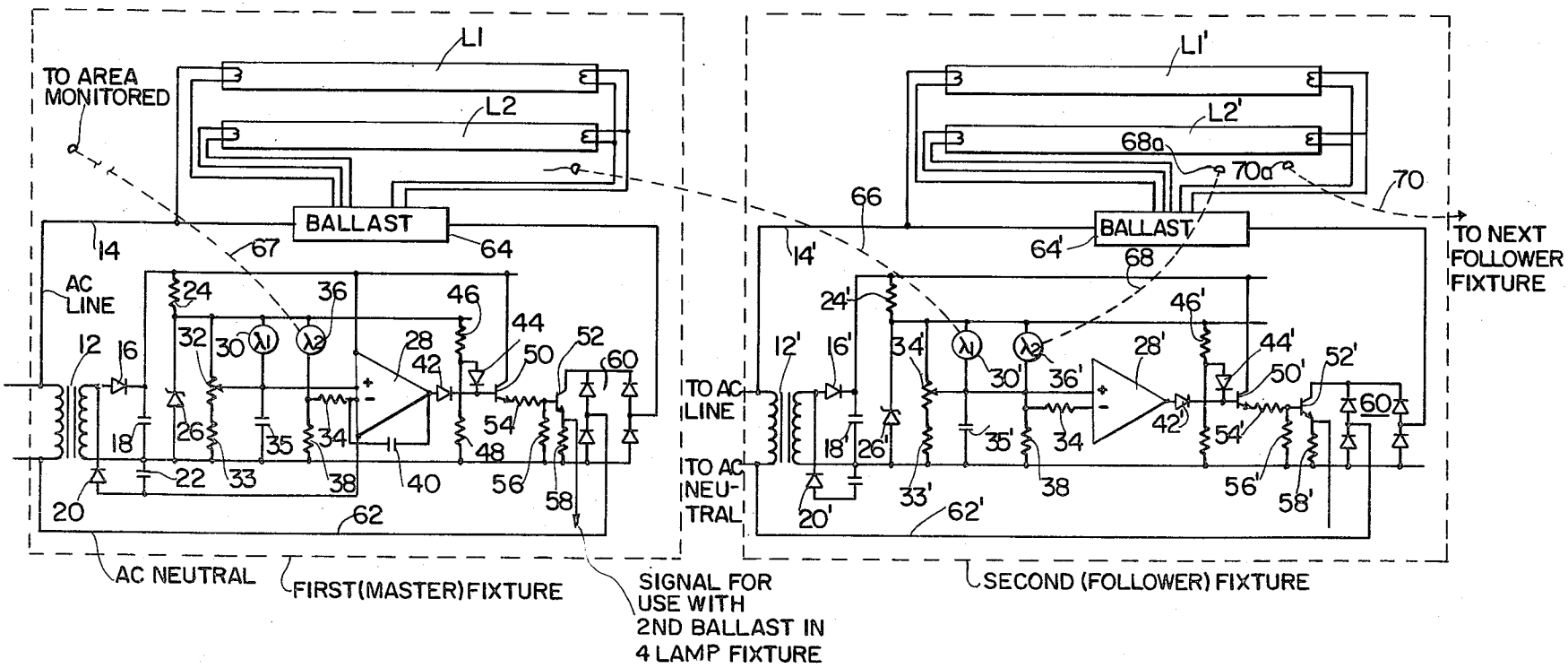
TO NEXT FOLLOWER FIXTURE
SECOND (FOLLOWER) FIXTURE
BALLAST
TO AC LINE
TO AC NEU-TRAL
SIGNAL FOR USE WITH 2ND BALLAST IN 4 LAMP FIXTURE
FIRST (MASTER) FIXTURE
BALLAST
TO AREA MONITORED
AC LINE
AC NEUTRAL

LIGHT REGULATION SYSTEM

CROSS REFERENCE TO RELATED APPLICATION

This application is a continuation-in-part of copending, commonly assigned continuation-in-part application Ser. No. 945,842, filed on Sept. 26, 1978.

FIELD OF THE INVENTION

The present invention relates to light regulation systems and, in particular, to a light regulation system for ballasted fluorescent lamps.

BACKGROUND OF THE INVENTION

In copending, commonly assigned continuation-in-part application Ser. No. 945,842, filed on Sept. 26, 1978, there is disclosed a master-follower light regulator system which is designed to utilize daylight and overcome other disadvantages of conventional fluorescent lamp systems, as well as to reduce the amount of electrical energy used to provide fluorescent lighting in buildings and the like. The basic component of the system is an electronic regulator in each fixture which is equipped to adjust to the ambient lighting.

The application discloses that a second or subsequent fixtures can be controlled by a master, or in the case of a plurality of fixtures, either by the master or a preceeding fixture. The application also contains a discussion of the problem of controlling the light output of fluorescent lamps operating from more than one inductive ballast. In brief, where it is desired to control the light output of two or more separately ballasted units containing pairs of lamps without paying the substantial economic penalties associated with providing a separate control system for each unit, certain problems must be overcome. Specifically, two ballasts cannot be operated in parallel from a single control system because the lamp pairs act in such a manner that only the pair that first reaches the arc discharge region is actually controlled. As a solution to this problem, the application discusses the provision of a conductive coupling from the emitter of a control transistor of a ballast control device, which coupling is used as a control input for controlling the primary current of the inductive ballast of the follower unit. Moreover, the application in question provides for the use of electro-optical devices to eliminate the wiring employed in the conductive coupling between the master units.

SUMMARY OF THE INVENTION

Generally speaking, the invention concerns a light regulating system wherein the optical coupling is employed between a first and second (or subsequent) fixture equipped with a control device as provided for in the parent application referred to above so that the light output of the follower fixture can be referenced, i.e., matched or otherwise related, to the light output of the master fixture. The optical coupling is used in lieu of the conductive coupling disclosed in the application referred to above and provides a number of important advantages. In this latter regard, one obvious advantage is that the need for electrical signal conductors between each fixture is eliminated. Moreover, the simplicity of this approach enhances system reliability. Further in this regard, the signal derived from the reference fixture lamp or lamps is a high level signal with a very high signal-to-noise ratio. Other advantages are discussed below.

Thus, in accordance with the invention, a light regulation system is provided for controlling the output of a following fixture including at least one lamp in accordance with the light output of a master fixture including at least one lamp, each fixture comprising a ballast for its lamp(s) and a control or regulating device for controlling the ballast and hence the light output of the lamp(s). The system comprises optical-electrical transducer(s) in the regulating device of each fixture for controlling the output of that fixture. The light output of the master fixture is preferably controlled by comparing a reference signal generated by a potentiometer with a light feedback signal derived from the ambient area light. The light output of an optically coupled follower fixture is controlled by the light level in the master fixture or another follower fixture. It is noted that in order to make the regulator device similar for both master and follower fixtures two photocells are preferably employed in each regulator device. However, one of these photocells is not used in the master unit because the reference or feedback signal described below is not generated in the master fixture as is the case for the follower fixtures. The master fixture does include a light sensor for sensing the ambient light and thus the output of the follower lamp can be regulated in accordance with the ambient light. The light collecting and coupling means between master and follower fixtures advantageously comprises a bundle of a fiber optics including a light collector placed in a light chamber of the master fixture. The fiber optics thus transmits a light signal related to the light level in the master fixture to the subsequent fixture.

The subsequent fixture further comprises a feedback arrangement for sensing a parameter related to the light output of its own lamps which is used for controlling the control of regulator device of the subsequent fixture by comparing the input and feedback light signals. The feedback arrangement preferably comprises a further optical-electrical transducer for controlling said control device in combination with light collecting and coupling means for collecting the light output of the monitored lamp(s) in the subsequent fixture and for coupling this light output to a further optical-electrical transducer. In addition, further light collecting and coupling means can be provided for collecting the light output of the monitored lamp(s) of the subsequent fixture and for coupling the same to an additional fixture so that this unit is also controlled. Continuing on in this manner, any number of subsequent following fixtures can be controlled.

Other features and advantages of the invention will be set forth in, or apparent from, the detailed description of the preferred embodiments found hereinbelow.

BRIEF DESCRIPTION OF THE DRAWINGS

The single FIGURE in the drawings is a schematic circuit diagram of a master and follower unit constructed in accordance with the invention.

DESCRIPTION OF THE PREFERRED EMBODIMENTS

Referring to the drawings, a schematic circuit diagram is shown of a master and optically coupled follower fixture in accordance with the invention. The follower fixture is controlled in cooperation with the light level within the master fixture. The regulator devices (control circuitry) employed in the fixtures are of the general form described in the aforesaid copending application and may be either a single ballast system, a dual ballast system or a variation thereof. As will be evident from a consideration of the copending application the circuitry employed in the single ballast embodiment disclosed in that application is similar to that of the fixtures shown in the drawings here.

It will readily be seen that the master and follower fixtures are nearly identical and components in the follower fixture have been given the same reference numerals as the corresponding components in the master unit, with a prime attached. Considering the regulator circuitry of the master fixture for purposes of explanation, this circuitry, as illustrated, includes an input transformer 12 which is connected to a bus or line 14 carrying the A.C. line voltage (whcih may be 120 VAC, 277 VAC or other available line voltages) and which steps down this voltage to a suitable voltage (10 volts in a specific example). The stepped down voltage appears on the isolated secondary winding of transformer 12 and is halfwave rectified by a diode 16. The positive half cycle of the voltage charges a capacitor 18 to a level (the plus or positive supply level) which is approximately 14 VDC above voltage of the common bus, referred to hereinafter as the signal common. A further diode 20 permits the 10 VAC secondary voltage to charge a further capacitor 22 to a level (the minus supply) which is approximately 14 VDC below the signal common. A series combination of a resistor 24 and a zener diode 25 are connected between the positive supply and signal common, with the zener diode 26 providing a regulated supply voltage for signal generation purposes.

The circuitry also includes an operational amplifier 28 connected in a non-inverting differential input mode. The positive input of operational amplifier 28 is connected to the junction between a first photocell 30 and a capacitor 35 while the negative input is connected through a resistor 34 to a junction between a second photocell 36 and a further resistor 38. The first mentioned junction is also connected to the tap of a potentiometer 32 which is connected in series with a fixed resistor 33. Potentiometer 32 permits the light output of the follower fixture to be matched or otherwise related to that of the master fixture as explained below. Resistor 34 is part of an RC time constant circuit that further includes a capacitor 40. The operational amplifier 28 is also connected to the positive and negative supplies and the output thereof is connected to a further diode 42 which is, in turn, connected to an additional diode 44 whose anode is also connected to a pair of voltage dividing resistors 46 and 48, one or both of which may be thermistors for thermal compensation purposes. The values of resistors 46 and 48 are selected so as to provide a minimum "turn on" signal through diode 44 for a control transistor 40.

Transistor 50 drives a further transistor 52 and is connected to the latter through a series resistor 54 and a shunt resistor 56. Resistor 56 helps compensate for the changing beta of transistor 52 as the latter heats up. A further resistor 58 is connected in the emitter path of transistor 50 and a signal is tapped off above this resistor which is used as the control input signal with the second regulator-ballast combination (not shown) in the fixture. A full wave bridge 60 is connected across the collector-emitter circuit of transistor 50. Bridge 60 is connected to the AC neutral line 62 and to the inductive ballast 64 for the lamps L1 and L2 of the follower unit.

The essential difference between the regulator circuitry of the present application and that of the above-mentioned embodiment of copending application is in the signal generating circuitry connected in the plus base of the operational amplifier, i.e., in components 30, 32, 33 and 35. In essence, photocell 30 is added along with the filter capacitor 35, and resistor 33. In a master fixture no fiber optics bundle is connected to photocell 30 and hence a minimal signal is generated and potentiometer 32 is used to generate the reference signal for the plus base input. In the second (follower) fixture a light signal is fiber optically coupled to corresponding photocell 30' to generate the reference signal and potentiometer 32' is used only as a signal adjust potentiometer.

Considering the follower fixture in more detail and in comparison with the master fixture, photocell 30' is optically connected by virtue of a fiber optic bundle 66 and associated light lens **66*a* to the master fixture whose lamps thus provide an optical command signal for the follower unit. Photocell 36' is similarly optically connected to the follower fixture through a further fiber optic bundle 68 and associated light lens 68*a*. A similar optical connection is provided in the master fixture with the difference that photocell 36 is optically coupled by fiber optic bundle 67 to a light lens 67*a* which senses the light level in the room or other selected area whose lighting is being monitored. Turning again to the follower fixture, a third fiber optic bundle 70 and associated light lens 70*a* may be provided so as to sense the light level in the follower fixture, or again in the master, and thereby provide a light signal which constitutes the command signal for second (next) follower fixture. Improved follower fixture accuracy is obtained in the follower unit if the 6V reference end of potentiometer 34' is disconnected because photocell 30'** is then free of any shunt resistance.

The operation of the light regulating system of the invention will be apparent from the foregoing. Briefly considering the operation of the follower fixture, the light output from the master as sensed by light lens **66*a* is converted into an electrical command signal which is used as a reference signal for comparison with the light feedback signal from the lamps L1' and L2' in the follower fixture, provided by light lens 68*a* and fiber optic bundle 68, in the control circuitry of the follower unit so as to generate an error signal to control the system. As discussed above, a further light signal carried by fiber optic bundle 70** taken from the first follower fixture and is in turn used to generate the command for another or second follower unit (not shown). The second follower unit can also use a light signal from its own lamps to provide a command input to a third follower unit and so on. Thus the light output of the first follower unit, i.e., that illustrated in the drawings, is matched or otherwise related to the light output of the master unit and the second follower would match its light output to that of the first follower and so on, via a non-electrical conducting fiber optic coupling between the respective fixture control units. The feedback signal used in follower units could, in lieu of light, be current feedback picked up at a suitable circuit node which goes positive with respect to signal common with an increase in ballast current. In practice, either the conductive coupling or the optical coupling discussed above might be used for the second ballast in the same fixture but the aforementioned optical coupling would be preferred between separate fixtures.

Turning now to a brief consideration of the overall operation of the system, the light sensor 67a in the master unit senses the ambient light and the unit adjusts the power levels that are used to light the fluorescent lamps L1 and L2 in the master fixture. Signals for driving the follower fixtures are derived from the master fixture and are conducted to the follower fixture over the fiber optic cables or bundles 66 as described above.

The use of the fixture lamps as the signal source for the follower fixture has many advantages. For example, the overall cost is kept low in that only simple components are required to generate a signal. Further, the system reliability is enhanced greatly by this simplicity. Also, the control "signal" is derived from a high watt tube or tubes; therefore, it is a high level signal with a very high signal to noise ratio. Further, the signal source is renewed when a lamp is replaced. In addition, no electrical connection for signals is necessary between fixtures, thereby further enhancing reliability. Further, providing interconnection between 120 V systems and 277 V systems does not require "special" interface equipment. Additionally, the system provides for single point light level adjustment for large areas, floors or even buildings.

It will be appreciated that zone lighting at varying lighting levels is easily accomplished at time of installation, and may be changed at any time with simple adjustment. Further, automatic timing and adjustment controls may be added by running computer level signals only to the master thereby enhancing the versatility of the system.

A further advantage of the invention is that there are no "extras" required for large installations. For a two-fixture installation wherein each fixture contains two lamps both the two-lamp master and follower require only three wires to be connected at installation. Similarly, each four-lamp master or follower would require only four wires to be connected at installation.

It will be understood that daylight entering the room is sensed by the room lighting sensor 67a and as the level of light is increased with increasing daylight, the level of light output from the fixtures is reduced proportionally. Power savings of 50% can be, and have been, achieved in windowed areas. In a typical example, a windowed area using twenty-five four-lamp fixtures would use 4600 watts (4.6 KW hr.) per hour to light these fixtures if they were not equipped with the regulator system of the invention. Using daylight to reduce input energy could result in a saving of as much as 2.3 KW jr per hour of usage. Thus, an annual usage of these fixtures of 3000 hours would result in an energy saving of 6900 KWh, or a saving of $345.00 based on a $0.05 per KWh rate. This is equivalent to saving a barrel or more of oil per fixture per year.

It is noted that a two resistor voltage divider connected to the regulated bus and the emitter of transistor 50, with its center tap connected to the circuit side of resistor which goes to the minus operational amplifier base, could be used to replace the feedback photocell-resistor signal generator to provide a feedback signal related to the arc current rather than using the lamp(s) light output.

It is also noted that while the term fluorescent lamp is used throughout the specification and claims, it is to be understood that the present invention is applicable to any gas discharge lamp operating in the arc discharge region of the operating characteristics thereof and thus the term fluorescent lamp is intended to encompass such lamps.

Although the invention has been described with respect to exemplary embodiments thereof, it will be understood that variations and modifications can be effected in the embodiments without departing from the scope or spirit of the invention.

I claim:

1. A light regulation system for controlling the output of at least one lamp in a follower fixture in accordance with the light output of a master fixture containing at least one lamp, said lamps comprising arc discharge lamps and said lamp units each comprising a ballast for the at least one lamp and a control device for controlling the ballast and hence the light output of the at least one lamp, said system comprising optical-electrical transducer means in the control device of said follower fixture for controlling the output of the control device of the follower fixture in accordance with the light input received thereby, and light collecting and coupling means for collecting the light output of the at least one master lamp and for coupling the said output of said at least one master lamp to said optical-electrical transducer means.

2. A light regulation system as claimed in claim 1 wherein said master unit includes means for sensing the ambient light in area which said master unit is located.

3. A light regulation system as claimed in claim 1 wherein said light collecting and coupling means comprises a bundle of fiber optic light conductors.

4. A light regulation system as claimed in claim 1 wherein said follower unit further comprises feedback means for sensing a parameter related to the light of output of said follower fixture and for controlling said control device of said follower fixture in accordance therewith.

5. A light regulation system as claimed in claim 4 wherein said feedback means comprises further optical-electrical transducer means for controlling said control device, and light collecting and coupling means for collecting the light output of said follower fixture and for coupling said light output to said further optical-electrical means.

6. A light regulation system as claimed in claim 1 wherein said master and follower fixtures each comprise an individual fixture in which said at least one lamp, said ballast and said control device are housed, said light collecting and coupling means comprising a light sensing lens and a fiber optic cable interconnecting said fixture.

7. A light regulation system as claimed in claim 1 wherein said control device of follower unit includes electrical adjusting means for adjusting the relationship between the light output signal from said master fixture and the light output of said follower fixture.

* * * * *